US010720000B2

(12) United States Patent
Comerford et al.

(10) Patent No.: US 10,720,000 B2
(45) **Date of Patent: *Jul. 21, 2020**

(54) DOOR LOCK SENSOR AND ALARM

(71) Applicant: Schlage Lock Company LLC, Carmel, IN (US)

(72) Inventors: Timothy N. Comerford, Indianapolis, IN (US); David M. Baty, Indianapolis, IN (US); William B. Ainley, Carmel, IN (US); Raymond F. Rettig, Fishers, IN (US); John R. Ahearn, Indianapolis, IN (US); Joseph W. Lyon, Fortville, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/233,854

(22) Filed: Dec. 27, 2018

(65) Prior Publication Data

US 2019/0206166 A1 Jul. 4, 2019

Related U.S. Application Data

(63) Continuation of application No. 15/831,900, filed on Dec. 5, 2017, now Pat. No. 10,169,942, which is a (Continued)

(51) Int. Cl.
*G07C 9/00* (2020.01)
*E05B 45/06* (2006.01)

(Continued)

(52) U.S. Cl.
CPC ..... *G07C 9/00309* (2013.01); *E05B 45/04* (2013.01); *E05B 45/06* (2013.01);

(Continued)

(58) Field of Classification Search
CPC .... G08B 13/06; G08B 13/08; G08B 13/2442; G08B 13/122; E05F 15/70; G07C 9/00309; E05B 45/06; E05B 65/00
See application file for complete search history.

(56) References Cited

U.S. PATENT DOCUMENTS 4,663,621 A 5/1987 Field et al.
4,833,465 A 5/1989 Abend et al.

(Continued)

FOREIGN PATENT DOCUMENTS

DE 202009010418 U1 7/2009
EP 2284336 A2 2/2011
WO 2012096647 A1 7/2012

OTHER PUBLICATIONS

International Search Report; International Searching Authority; US Patent and Trademark Office; International Application No. PCT/US2013/042497; dated Jul. 20, 2013; 2 pages.

(Continued)

*Primary Examiner* — Hoi C Lau
(74) *Attorney, Agent, or Firm* — Taft Stettinius & Hollister LLP

(57) ABSTRACT

A door lock mechanism is disclosed that includes door lock end alarm features. The mechanism includes a controller and a sensor useful to detect motions that are representative of attempted access through a door to which the door lock mechanism is attached. The controller can set an alarm condition if a measured motion, such as a measured acceleration, meet and/or exceeds a threshold. If an appropriate access control credential is provided through a user device then the alarm condition may not be set by the controller. The door lock mechanism can be coupled to a remote station via a communications link if needed, such as a radio frequency link. The remote station can additionally be in communication with the door lock mechanism via a net- (Continued)

work. The remote station can be used to send and receive messages regarding door lock mechanism status, configuration, etc.

20 Claims, 8 Drawing Sheets

Related U.S. Application Data continuation of application No. 15/175,407, filed on Jun. 7, 2016, now Pat. No. 9,836,903, which is a continuation of application No. 13/901,293, filed on May 23, 2013, now Pat. No. 9,361,771.

(60) Provisional application No. 61/650,830, filed on May 23, 2012.

(51) Int. Cl.

| | |
|---|---|
| ***G08B 13/06*** | (2006.01) |
| ***E05B 65/00*** | (2006.01) |
| ***E05B 45/04*** | (2006.01) |
| ***E05B 47/00*** | (2006.01) |

(52) U.S. Cl.

CPC ..... *E05B 47/0001* (2013.01); *E05B 65/00* (2013.01); *G08B 13/06* (2013.01); *E05B 2045/063* (2013.01); *E05B 2045/065* (2013.01); *E05B 2045/067* (2013.01); *E05B 2047/0058* (2013.01)

(56) References Cited

U.S. PATENT DOCUMENTS

| | | | | |
|---|---|---|---|---|
| 5,663,704 | A | 9/1997 | Allen et al. | |
| 5,823,582 | A | 10/1998 | Frolov et al. | |
| 5,878,530 | A | 3/1999 | Eccleston et al. | |
| 5,988,708 | A | 11/1999 | Frolov et al. | |
| 5,999,095 | A | 12/1999 | Earl et al. | |
| 6,422,463 | B1 | 7/2002 | Flink | |
| 6,472,984 | B1 | 10/2002 | Risi | |
| 6,516,569 | B2 | 2/2003 | Schweitzer | |
| 6,564,600 | B1 | 5/2003 | Davis | |
| 6,609,738 | B1 | 8/2003 | Roth et al. | |
| 6,784,784 | B1 | 8/2004 | Zehrung | |
| 7,038,409 | B1 | 5/2006 | Mullet | |
| 7,170,998 | B2 | 1/2007 | McLintock et al. | |
| 7,491,926 | B1 | 2/2009 | Anderson et al. | |
| 7,668,621 | B2 | 2/2010 | Bruemmer | |
| 7,834,309 | B2 | 11/2010 | Anderson et al. | |
| 7,847,675 | B1 | 12/2010 | Thyen et al. | |
| 7,872,577 | B2 | 1/2011 | Frolov et al. | |
| 7,971,459 | B2 | 7/2011 | Price | |
| 8,370,911 | B1 | 2/2013 | Mallard | |
| 8,764,071 | B2 | 7/2014 | Lanigan et al. | |
| 8,957,757 | B1 | 2/2015 | Le Burge et al. | |
| 9,317,987 | B2 | 4/2016 | Cleveland et al. | |
| 9,361,771 | B2 * | 6/2016 | Comerford | G08B 13/06 |
| 9,382,739 | B1 | 7/2016 | Johnson et al. | |
| 9,805,534 | B2 | 10/2017 | Ho et al. | |
| 9,836,903 | B2 * | 12/2017 | Comerford | G08B 13/06 |
| 10,169,942 | B2 * | 1/2019 | Comerford | G08B 13/06 |
| 2002/0099945 | A1 | 7/2002 | McLintock et al. | |
| 2002/0154012 | A1 | 10/2002 | Risi | |
| 2003/0006879 | A1 | 1/2003 | Kang et al. | |
| 2003/0071739 | A1 | 4/2003 | Addy et al. | |
| 2004/0040353 | A1 | 3/2004 | Yu et al. | |
| 2004/0257215 | A1 | 12/2004 | Eskildsen | |
| 2005/0055146 | A1 | 3/2005 | Ide | |
| 2005/0253710 | A1 | 11/2005 | Eskildsen | |
| 2005/0285553 | A1 | 12/2005 | Gregori et al. | |
| 2006/0242908 | A1 | 11/2006 | McKinney | |
| 2007/0090921 | A1 | 4/2007 | Fisher | |
| 2008/0034818 | A1 | 2/2008 | Vinadio | |
| 2008/0055040 | A1 | 3/2008 | Lizza et al. | |
| 2008/0061963 | A1 | 3/2008 | Schnitz et al. | |
| 2008/0079580 | A1 | 4/2008 | Shelton et al. | |
| 2008/0094171 | A1 | 4/2008 | Sawhney | |
| 2008/0238669 | A1 | 10/2008 | Linford | |
| 2009/0026355 | A1 | 1/2009 | Anderson et al. | |
| 2009/0027194 | A1 | 1/2009 | McGrath | |
| 2009/0027197 | A1 | 1/2009 | Frolov et al. | |
| 2009/0051528 | A1 | 2/2009 | Graichen | |
| 2009/0066320 | A1 | 3/2009 | Posey | |
| 2009/0102653 | A1 | 4/2009 | McGinnis et al. | |
| 2009/0114801 | A1 | 5/2009 | Dipoala et al. | |
| 2009/0140858 | A1 | 6/2009 | Gore et al. | |
| 2009/0165682 | A1 | 7/2009 | Cleveland et al. | |
| 2009/0249699 | A1 | 10/2009 | Yulkowski | |
| 2010/0019902 | A1 | 1/2010 | Mullet | |
| 2010/0033329 | A1 | 2/2010 | Davis et al. | |
| 2010/0097225 | A1 | 4/2010 | Petricoin, Jr. | |
| 2010/0176950 | A1 | 7/2010 | Bartholf et al. | |
| 2010/0223170 | A1 | 9/2010 | Bahar | |
| 2010/0237634 | A1 | 9/2010 | Gandhi | |
| 2010/0242368 | A1 | 9/2010 | Yulkowski | |
| 2010/0283579 | A1 | 11/2010 | Kraus et al. | |
| 2010/0302025 | A1 | 12/2010 | Script | |
| 2011/0016971 | A1 | 1/2011 | Yulkowski et al. | |
| 2011/0043362 | A1 | 2/2011 | Reibel | |
| 2011/0057788 | A1 | 3/2011 | Talkington et al. | |
| 2011/0245978 | A1 | 10/2011 | Farrell et al. | |
| 2012/0012606 | A1 | 1/2012 | Longley et al. | |
| 2012/0055091 | A1 | 3/2012 | Backherms et al. | |
| 2012/0239191 | A1 | 9/2012 | Versteeg et al. | |
| 2013/0038498 | A1 | 2/2013 | Ferrer-Herrera et al. | |
| 2013/0057404 | A1 | 3/2013 | Thibault | |
| 2013/0057405 | A1 | 3/2013 | Seelman et al. | |
| 2013/0257611 | A1 | 10/2013 | Lamb et al. | |
| 2013/0300564 | A1 | 11/2013 | Lamb | |
| 2013/0327142 | A1 | 12/2013 | Hogan et al. | |
| 2013/0335222 | A1 * | 12/2013 | Comerford | G08B 13/06 340/542 |
| 2014/0001779 | A1 | 1/2014 | Bedoian et al. | |
| 2014/0113828 | A1 | 4/2014 | Gilbert et al. | |
| 2014/0176308 | A1 | 6/2014 | Lee | |
| 2014/0240504 | A1 | 8/2014 | Cho | |
| 2014/0252020 | A1 | 9/2014 | Longley et al. | |
| 2014/0340032 | A1 | 11/2014 | Curtis | |
| 2016/0180618 | A1 | 6/2016 | Ho et al. | |
| 2016/0292944 | A1 * | 10/2016 | Comerford | G08B 13/06 |
| 2016/0358433 | A1 | 12/2016 | Johnson | |
| 2017/0016252 | A1 | 1/2017 | Uhlmann | |
| 2017/0090447 | A1 | 3/2017 | Skocypec et al. | |
| 2017/0307651 | A1 | 10/2017 | Ten Kate | |
| 2018/0158268 | A1 * | 6/2018 | Comerford | G08B 13/06 |
| 2019/0206166 | A1 * | 7/2019 | Comerford | E05B 45/04 |

OTHER PUBLICATIONS

First Examination Report; New Zealand Patent Office; New Zealand Patent Application No. 703361; dated Feb. 29, 2016; 3 pages.

Second Examination Report; New Zealand Patent Office; New Zealand Patent Application No. 703361, dated Feb. 29, 2016; 3 pages.

Third Examination Report; New Zealand Patent Office; New Zealand Patent Application No. 703361; dated Jun. 15, 2016; 4 pages.

Mexican Office Action, Mexican Patent Office, Mexican Patent Application No. MX/a/2017/014315, dated May 24, 2019, 6 pages.

* cited by examiner

| | Portal Selection Functional Icon | Local | Portal State Icon s | Z-wave Message<br><br>Portal to Lock | Z-wave Message<br><br>Lock to Portal |
|---|---|---|---|---|---|
| Function | | | | | |
| Alarm On/Off (On/Off control all alarm functions -- local & portal) | On, Off | On, Off | On or Off | Yes | Yes |
| Modes | Activity, Tamper, Forced Entry (one active mode at any time) | Activity, Tamper, Forced Entry: Tamper and Forced Entry temporarily disable when lock is un-locked via PIN, Z-wave, or key/thumb-turn | Selected Mode Activity Tamper, Forced Entry | Yes | Yes |
| Sensitivity | 1 (most sensitive)<br>5 (least sensitive)<br>3 is default | Same as local | Sensitivity Setting 1-5 | Yes | Yes |
| Alarm Status (Is an alarm in process?) | n/a | Sounder, if enabled, No local sounder if Text/Email only | Active or Not Active | No | Yes |
| Cancel Alarm | Cancel button | Press & hold Schlage 5 seconds | n/a | Yes | Yes |
| Local Schlage Button Diable (Disables local Alarm On/Off, Mode, and Sensitivity changes) | Schlage Disable Button (NOT IMPACTED: Local user can still cancel an alarm and perform Quick Check) | n/a | Yes | Yes | No |
| Notification | Sound only<br>Text/Email only<br>Sound and Text/Email | n/a | Notification type | Yes | No |

FIG 8

| Mode | Local reaction to 4 invalid PINs | Z-Wave reaction to 4 invalid PINs |
|---|---|---|
| Tamper Mode | If the local alarms are in Tamper mode and 4 consecutive invalid PINs occur then the local alarm will sound for 15 seconds and the normal UI will be displayed.<br><br>If continued Tamper attempts are detected beyond the lockout interval then the alarm modes will act as normal and continue to alarm. | In conjunction with the local alarms a Tamper mode Z-Wave message will be sent to the portal along with the lockout message.<br><br>If continued Tamper attempts are detected beyond the lockout interval then additional Z-Wave alarm messages will be sent. |
| Kick-in Mode | If the local alarms are in Kick-In mode and 4 consecutive invalid PINs occur then the local alarm will sound for 30 seconds and the normal UI will be displayed.<br><br>If continued Kick-In attempts are detected beyond the lockout interval then the alarm modes will act as normal (3-minutes for Kick-In) and continue to alarm. | In conjunction with the local alarms a Kick-In mode Z-Wave message will be sent to the portal along with the lockout message.<br><br>If continued Kick-In attempts are detected beyond the lockout interval then additional Z-Wave alarm messages will be sent. |
| Local Alarms Off | Local alarms will not occur in the event of a lockout occurrence if the alarms are in OFF mode. | Z-Wave messages related to Tamper and Kick-In will not be sent in the event of a lockout occurrence if the alarms are in the OFF mode. |

FIG 9

DOOR LOCK SENSOR AND ALARM

CROSS REFERENCE TO RELATED APPLICATIONS

The present application is a continuation of U.S. patent application Ser. No. 15/831,900 filed Dec. 5, 2017 and issued as U.S. Pat. No. 10,169,942, which is a continuation of U.S. patent application Ser. No. 15/175,407 filed Jun. 7, 2016 and issued as U.S. Pat. No. 9,836,903, which is a continuation of U.S. patent application Ser. No. 13/901,293 filed May 23, 2013 and issued as U.S. Pat. No. 9,361,771, which claims the benefit of U.S. Provisional Patent Application 61/650,830 filed May 23, 2012. The contents of each application are hereby incorporated by reference in their entirety.

TECHNICAL FIELD

The present invention relates to door lock and sensor packages that can detect motion of doors, and more particularly, but not exclusively, to door lock and sensor packages that include the ability to authenticate a user.

BACKGROUND

Electronic door locks are commonly used in commercial settings and are increasingly being used in residential applications. Some of the electronic door locks can provide an alarm function or can be connected as an input to an alarm system to enhance the security of the building or facility. Some existing systems have various shortcomings relative to certain applications. Accordingly, there remains a need for further contributions in this area of technology.

SUMMARY

One embodiment of the present invention is a unique door lock and sensor combination. Other embodiments include apparatuses, systems, devices, hardware, methods, and combinations for communicating security information between the door lock and sensor combination and a remote station. Further embodiments, forms, features, aspects, benefits, and advantages of the present application shall become apparent from the description and figures provided herewith.

BRIEF DESCRIPTION OF THE DRAWINGS

FIG. 8 is a tabular description of further details of the lock mechanism.

FIG. 9 is a tabular description of further details of the lock mechanism.

DETAILED DESCRIPTION

Figure 1:
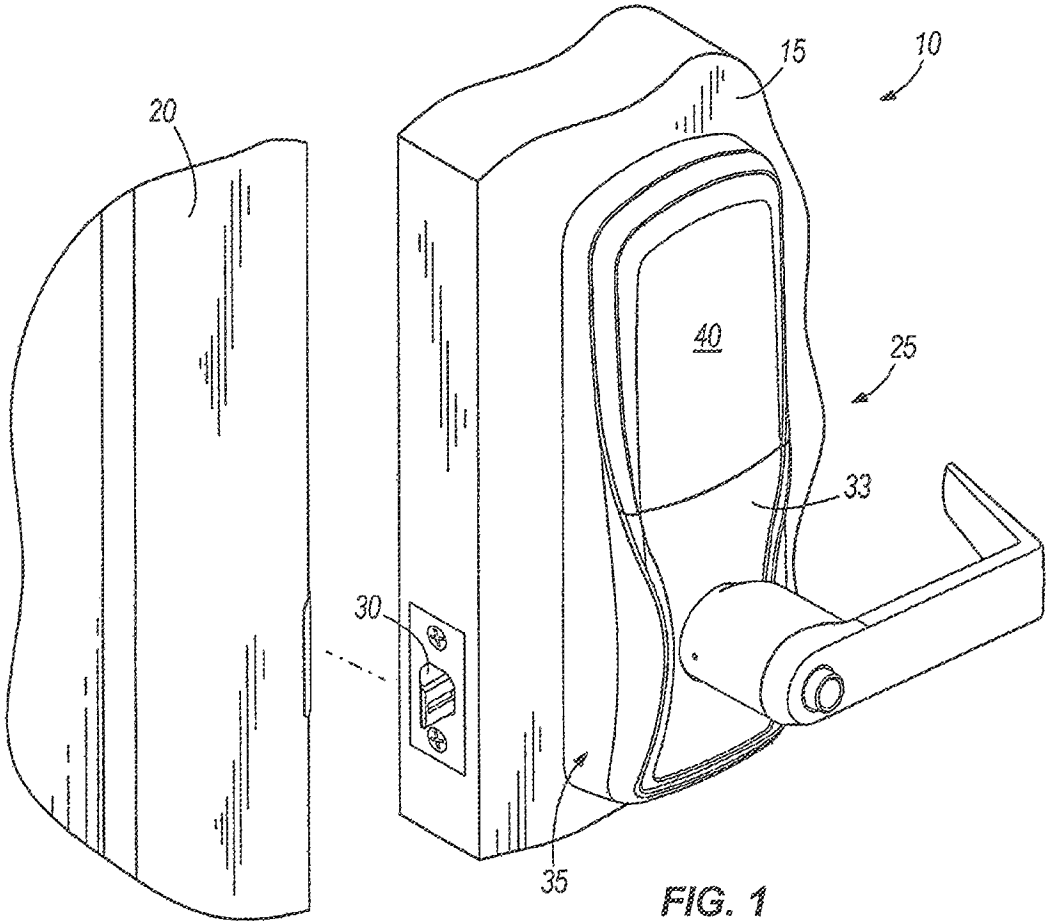
FIG. 1 is a perspective view of a portion of door including an electronic door lock.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrate a doorway or door assembly 10 that includes a door panel 15 pivotally supported within a frame 20. A lock mechanism 25 is coupled to the door panel 15 and operates to selectively inhibit movement of the door panel 15 from a closed position to an open position. The lock mechanism includes a latch 30 and an electronic actuator 33 having an interior portion 35 and an exterior portion attached to the door panel 15 to electronically control access via the door 10. FIG. 1 illustrates the interior portion 35 of the electronic actuator 33. Typically the interior portion 35 of the electronic actuator 33 includes a housing 40 that covers the electronics that make the access decision and an actuator that moves the mechanical components to open the door 10. The exterior portion of the electronic actuator 33 typically includes an input device such as a keypad, card reader, biometric scanner, and the like that read data from a user wishing to gain entry. The data provided at the exterior portion 35 of the electronic actuator 33 is then used to make an access decision or is transmitted to a remote device that makes the access decision.

Before proceeding, it should be noted that the description contained herein is directed to a system that includes an electronic actuator 33. However, the present invention could be applied to purely mechanical door locks as well if desired. Thus, in one embodiment the lock mechanism 25 does not include an electric actuator.

Figure 2:
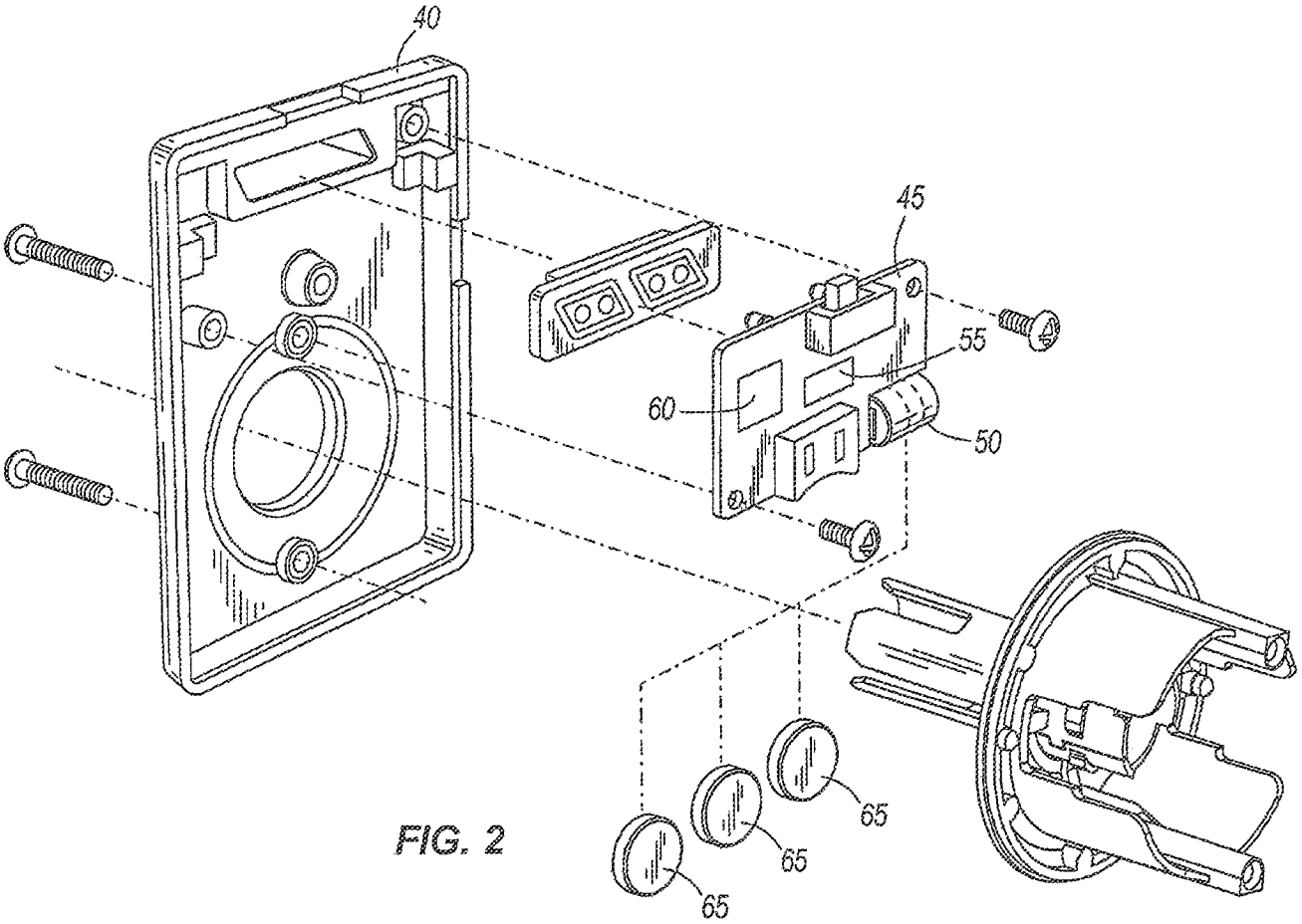
FIG. 2 is an exploded perspective view of the electronic door lock of FIG. 1.
Figure 3:
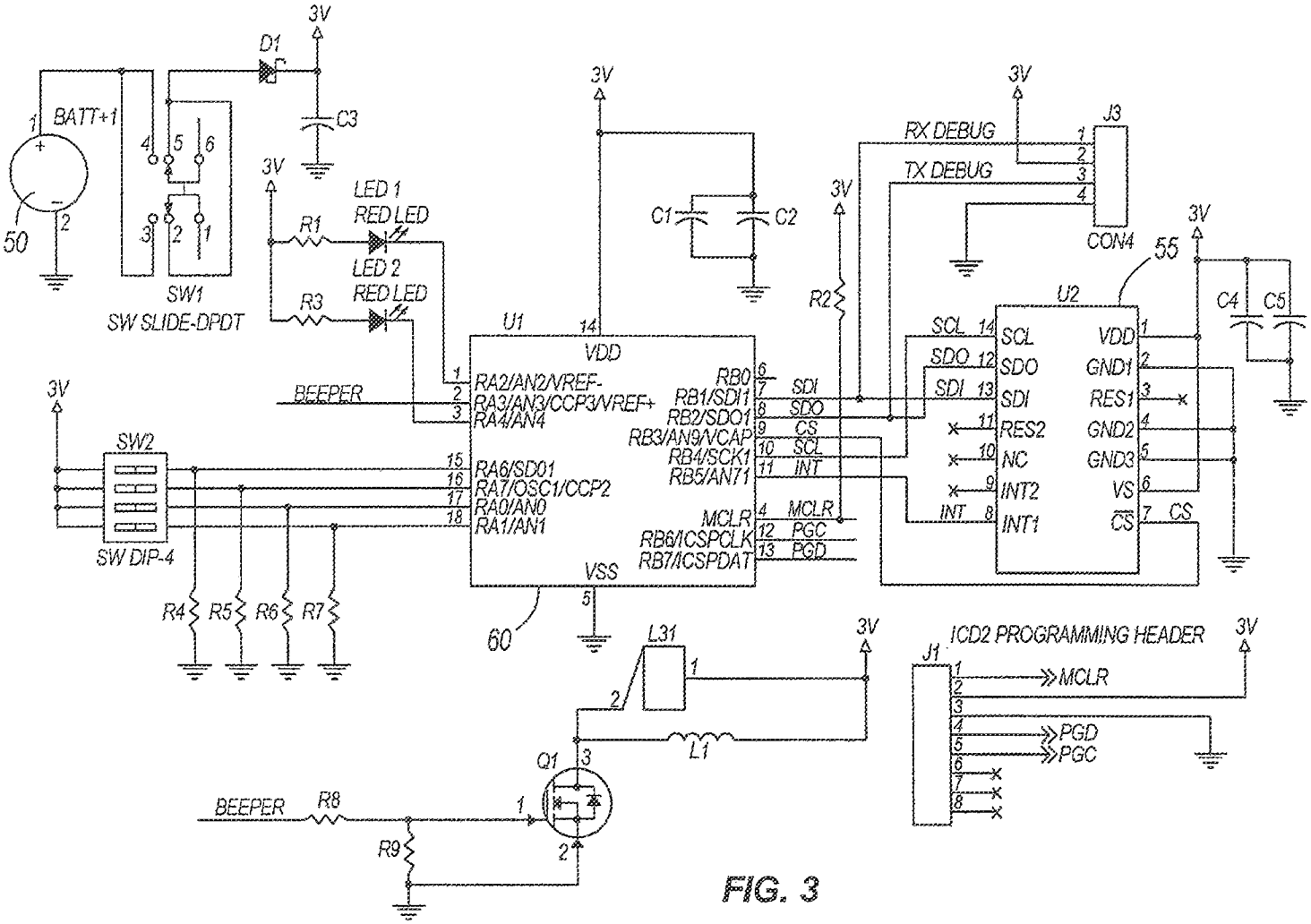
FIG. 3 is a schematic diagram of an acceleration detection circuit of the electronic door lock of FIG. 1.

As illustrated in FIG. 2 the interior portion of the electronic actuator 33 includes a housing 40 that contains a circuit board 45 that supports a power supply 50, a sensor 55, and a controller 60. The power supply 50 includes one or more batteries 65 in the form of coin cells that are operable to provide the main power to the circuit board 45 or alternatively to provide backup power should a main power supply fail. In one construction, an AC power supply is provided as main power with the battery or batteries 65 providing back up power. It should be noted that many different batteries having many different voltage outputs, shapes, and sizes could be employed as desired.

The sensor 55 is positioned on the circuit board 45 and is connected to the power supply 50 and the controller 60. As will be appreciated by those in the field, the sensor 55 is capable of sensing motions to which the lock mechanism 25 is subjected as a result of being attached to the door. In one construction the sensor 55 includes an accelerometer capable of measuring acceleration in one or more directions. In a preferred construction, a microelectromechanical system (MEMS) arrangement is employed as the accelerometer. The MEMS accelerometer is capable of measuring acceleration in one or more axes with three axes being preferred. Example of MEMS based accelerometers suitable for use in the illustrated device are manufactured by FREESCALE SEMICONDUCTOR having a principle place of business in Tempe, Ariz. and sold under the part numbers MMA7330L and MMA7341L. Another example of MEMS based accelerometers suitable for use in the device are manufactured by ST Micro having a place of business at 1525 Perimeter Parkway, Suite 420, Huntsville, Ala.

For purposes of this application, a single sensor 55 that measures acceleration in more than one direction can be considered as separate sensors 55 that each measure acceleration in a single direction or can be considered a single sensor 55. Each of the suitable MEMS based accelerometers noted herein provides a unique output sign that corresponds to the acceleration in one of three directions. Thus, an external device receives three separate signals that could be provided by a single acceleration measuring device or three separate acceleration measuring devices. In other constructions, one or more separate one axis sensors 55 can be employed to measure acceleration.

The controller 60 is positioned on the circuit board 45, is powered by the power supply 50, and receives signals from the sensor 55. In one construction, the controller 60 receives a single acceleration signal. The signal is analyzed by the controller 60 to determine if the measured acceleration exceeds a predetermined threshold 70. If the threshold 70 is exceeded, the controller 60 can store the measured data and can initiate an alarm if the measured data is indicative of an attempted forced entry. However, if only one axis of acceleration is measured, the system is susceptible to false alarms when the door panel 15 is slammed or closed quickly. Thus, in a preferred construction, signals indicative of acceleration in two or more directions are provided to the controller 60.

In some constructions, the controller 60 includes a micro-controller that is operable in a sleep state or an operating state to conserve power. When an acceleration is detected that exceeds a wake threshold 75, the micro-controller or controller 60 transitions from the sleep state to the operating state to perform the analysis necessary to determine the cause of the acceleration.

Figure 4:
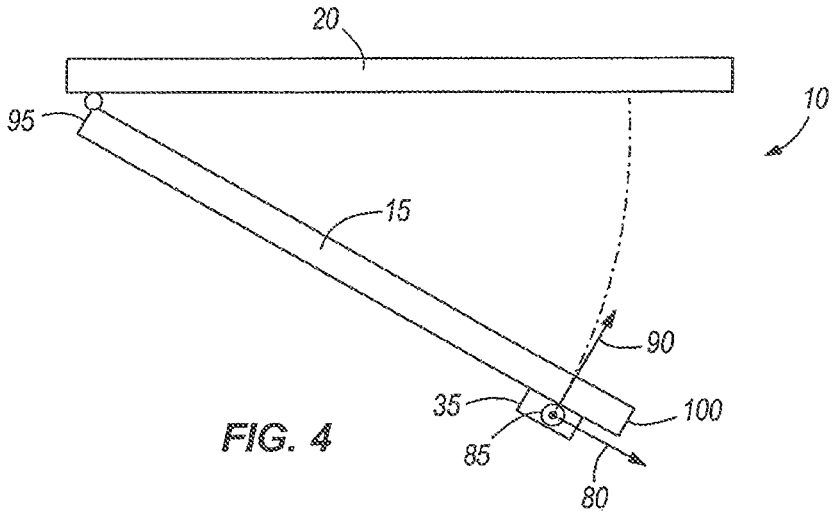
FIG. 4 is a top schematic view of the door of FIG. 1.

FIG. 4 schematically illustrates the doorway 10 with the door panel 15 in the open position. The axes along which accelerations are measured are illustrated as an X-axis 80, a Y-axis 85, and a Z-axis 90. The X-axis 80 extends in the width or horizontal direction from the edge 95 of the door panel 15 that is connected to the frame 20 to the edge 100 of the door panel 15 that selectively engages the door frame. The Y-axis is normal to the X-axis and extends vertically from the bottom edge of the door to the top edge of the door. The Z-axis is normal to the X-axis and the Y-axis and extends in a direction that is substantially tangent to an arc defined by the location of the accelerometer as the door moves between the open position and the closed position.

Figure 5:
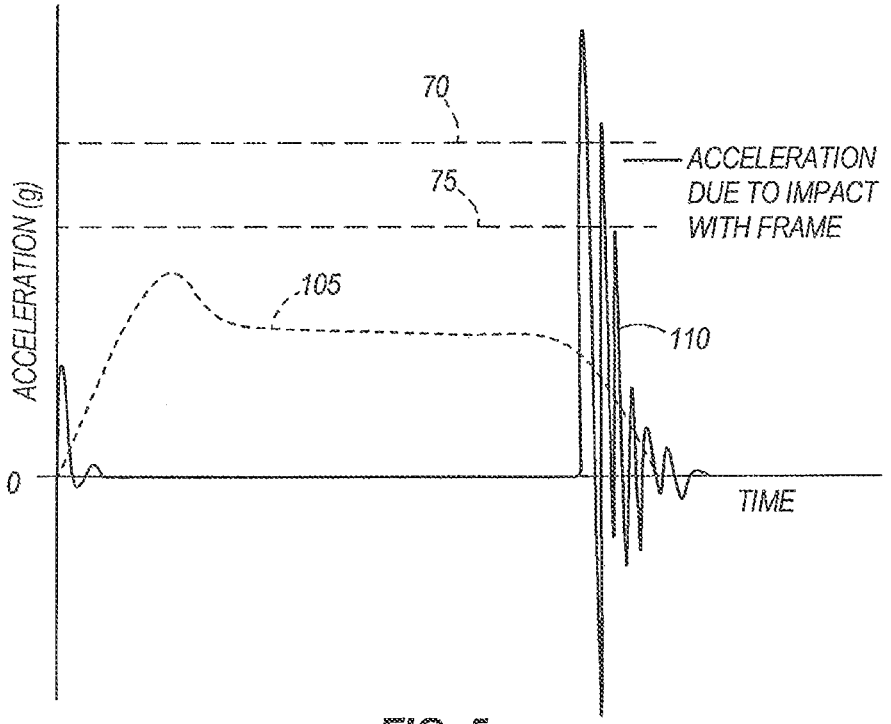
FIG. 5 is a graphical representation of the measured acceleration of a door during a normal close.

FIG. 5 graphically illustrates the measurements taken during a normal door closure with a system that measures acceleration in at least two directions. More specifically, FIG. 5 illustrates the accelerations measured in the X-axis as a first curve 105 and the Z-axis as a second curve 110 as the door panel 15 moves from a stationary open position to a stationary closed position. As the use begins to close the door panel 15, acceleration is measured both the X and Z directions. Eventually, the angular acceleration of the door panel 15 approaches zero such that the door panel 15 moves with a constant angular velocity toward the closed position. Thus, the accelerations in the Y-axis and Z-axis directions approach zero. However, the constant angular velocity of the door panel 15 does produce a substantially constant centripetal acceleration that is detected and displayed as acceleration in the X-axis direction. As the door panel 15 contacts the frame 20 near the closed position, the angular velocity (and the X-axis acceleration) begins to drop. Simultaneously, accelerations are measured in the Z-direction and potentially in the Y-direction. The magnitude of these accelerations and the direction of these accelerations vary depending on the velocity of the door panel 15 as well as the lock mechanism 25 employed. Thus, different patterns of acceleration will be produced by different doors 10 with the second curve 110 illustrating one example.

FIG. 5 also illustrates of possible wake threshold 75 and one possible alarm threshold 70. Of course other threshold levels 70, 75 could be employed if desired. In addition, the wake threshold 75 could be eliminated and the controller 60 could always remain in the operating state if desired.

The controller 60 will identify the curves of FIG. 5 as being indicative of a normal door closure. Specifically, the controller 60 will detect the accelerations at the end of the second curve 110 and will identify them as a potential attempted forced entry as they exceed the alarm threshold 70. However, the non-zero level of acceleration immediately prior to the acceleration illustrated in the first curve 105 would be detected by the controller 60 and would indicate that the door panel 15 was moving just prior to the large acceleration. The controller 60 would thus determine the cause of the high acceleration indicated by the first curve 105 at least partially by analyzing the acceleration of the second curve 110 just prior to the large detected acceleration. Thus, if a user slams the door panel 15, thereby producing accelerations at the end of the closure significantly higher than those illustrated or accelerations above the alarm set point 70, the controller 60 will prevent the alarm from being triggered.

In constructions that employ a single axis sensor 55, the sensor 55 will typically be oriented to measure accelerations along the Z-direction 90. Thus, during a normal door closure as illustrated in FIG. 5, only the second curve 110 will be available. However, the controller 60 can still identify this as a normal door closure event based on the in acceleration caused as the user accelerates the door from a stationary condition to a moving condition followed a few seconds later by the accelerations produced during contact with the door frame 20.

Figure 6:
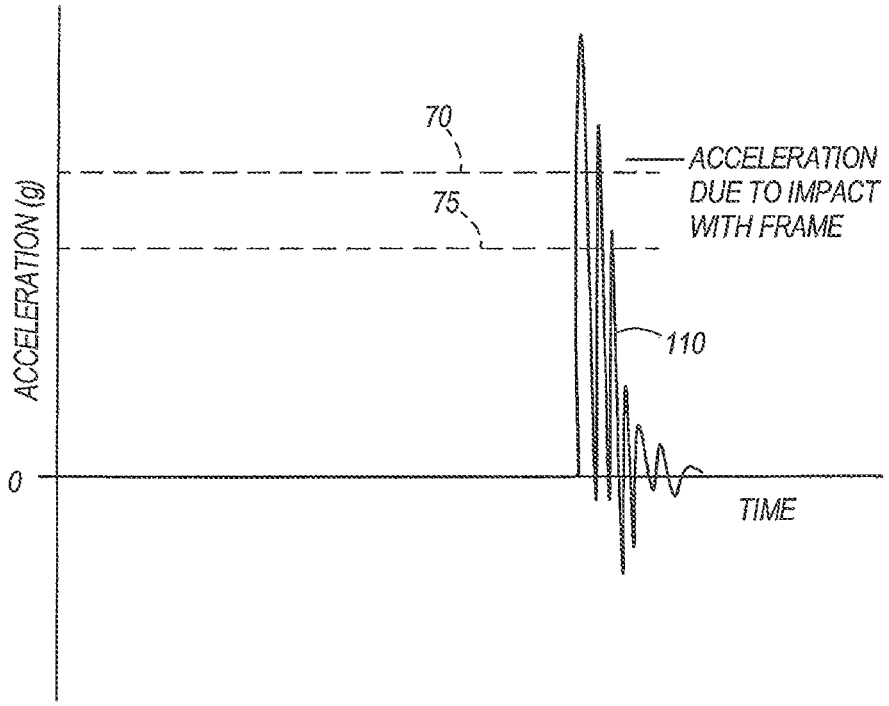
FIG. 6 is a graphical representation of the measured acceleration of a door during an attempted forced entry.

FIG. 6 illustrates the measured accelerations from the sensor 55 during an attempted forced entry. Typically, a forced entry produces significant acceleration in the Z-axis 90 with smaller accelerations in the X-axis 80 and Y-axis 85 directions. There is no acceleration similar to the X-axis 80 acceleration produced during movement of the door panel 15 toward the closed position, thereby making it easier for the controller 60 to identify this as an attempted forced entry rather than a normal closure. Thus, the controller can record the accelerations to document the attempted forced entry and can trigger an alarm even if the alarm threshold 70 is not exceeded.

As one of ordinary skill will realize, the controller 60 can be programmed to identify many different normal activities based on the measured accelerations to further reduce false alarms that might occur. The use of multiple accelerometers or a single accelerometer that measures acceleration in various directions provides additional information to the controller 60 to make it easier to filter normal activities from attempted forced entries.

The use of a multi-axis sensor 55 provides for the ability to monitor door openings and closings. Thus, the number of times a door opens or closes could be tracked and maintenance schedules could be set based on the number of openings and closings. In addition, the status of the doors could be monitored to verify that they are in the desired state. For example, doors that lead to secured areas could be monitored to verify that they are in the desired position. Thus, a door that is supposed to remain closed could be monitored to verity that the door closes within a predetermined time period after it opens. If the door does not close an alarm could be triggered. In arrangements that include only a single axis sensor 55, other sensors could be employed such as a door position sensor, a latch position sensor, and the like. As one of ordinary skill will realize, the multi-axis sensor 55 is advantageous as it can monitor the door position and the door status without the need for an additional sensor.

Thus, the invention provides, among other things, a door system that includes a lock that is operable to measure vibrations. More specifically, the invention provides a door system that includes a lock that can sense and detect an attempted forced entry. Various features and advantages of the invention are set forth in the following claims.

Further variations in the embodiments disclosed above are contemplated. For example, the lock mechanism 25 can include additional variations in which lock and alarm functions are further integrated. A number of additional variations are described further below but will be understood that the variations are applicable to any of the features described elsewhere in the application.

In some embodiments the controller 60 and the sensor 55 can be configured to communicate with each other such as, for example, over a communications link or a shared memory. In one particular non-limiting embodiment the sensor 55 shares one or more signals with the controller 60. In some embodiments the signals provided by the sensor 55 can be configured to be in the form of a message. For example, the sensor 55 can communicate a "wake-up" message to the controller 60 via serial data communications if a detected acceleration meets and/or exceeds a wake threshold 75. The sensor 55 can alternatively and/or additionally communicate a message that an acceleration has been detected that exceeds an alarm threshold 70. In some forms the alarm threshold 70 can be reported if an acceleration falls within a band of accelerations, while in other forms a message that reports the alarm threshold 70 can be sent if the acceleration falls within a band of accelerations. Thus, the term threshold as used herein can represent either a single numeric value that accelerations are tested against, or can represent a range of accelerations. In this way logic can be provided that tests whether the acceleration meets and/or exceeds an acceleration, or is within a range of accelerations. Thus the term threshold as associated with some embodiments herein is a term that includes satisfying a test of adequate accelerations as a condition to report activity of the lock mechanism.

The alarm threshold 70 and wake threshold 75 can be permanently configured thresholds, either within the sensor 55 or controller 60, but in alternative embodiments either or both thresholds can be adjusted. For example, the thresholds 70 and 75 can be individually configured in some embodiments, while in other embodiments the thresholds 70 and 75 can be coupled together such that adjusting one threshold automatically adjusts the other threshold. In still further forms a single user setting can be used to specify the operation of the controller 60 and sensor 55. In this way a range of sensitivity settings could be provided such that the user selects an appropriate level.

Figure 7:
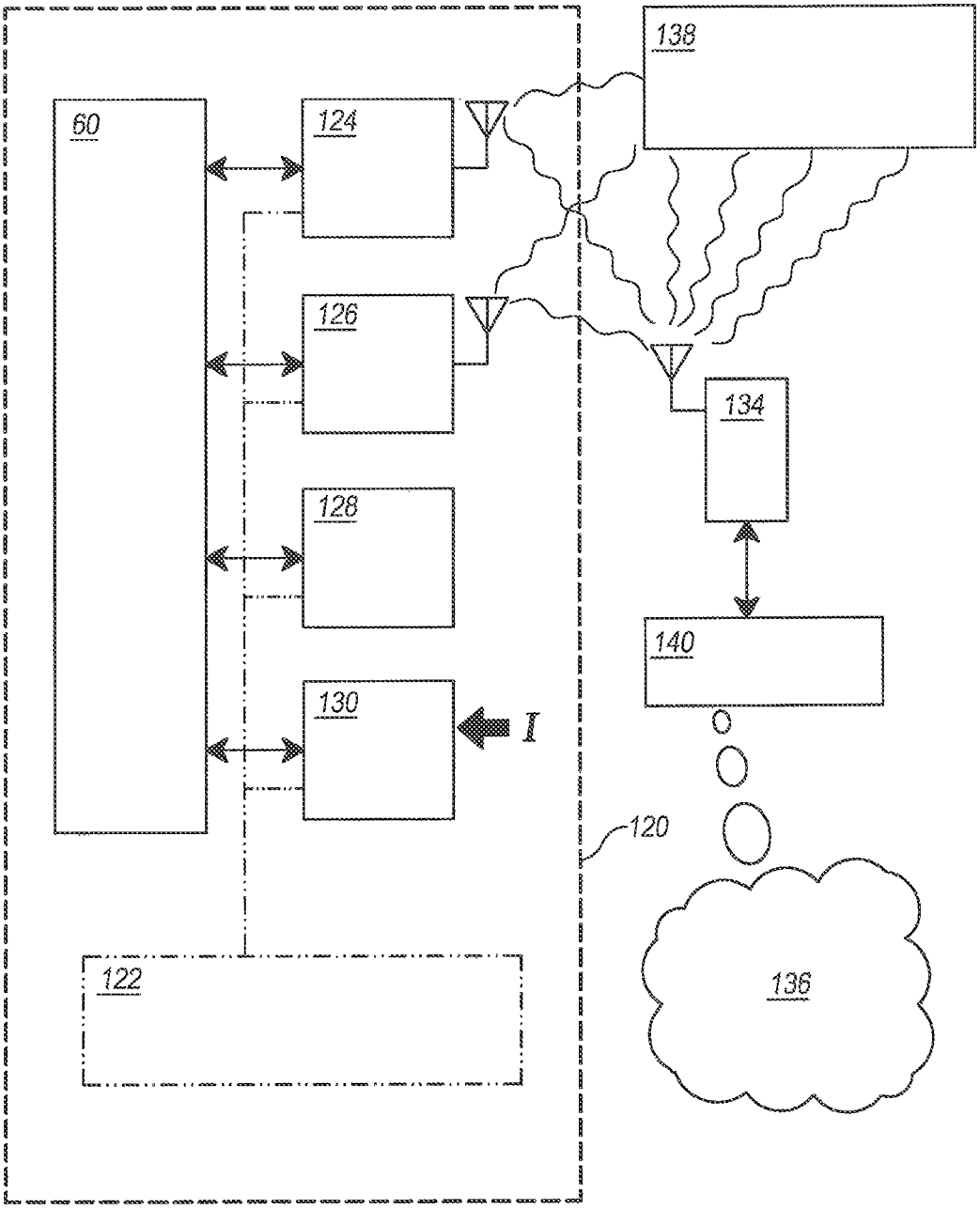
FIG. 7 is a representation of the lock mechanism.

With reference to FIG. 7 there is illustrated exemplary circuitry 120 used with an embodiment of the lock mechanism 25 that permits communication between the lock mechanism 25 and an external communications device. Circuitry 120 includes power supply 122, transceiver 124, receiver 126, position sensing and motor control circuitry 128, user input circuitry 130, and controller 60. Power supply 122 is preferably a battery-based power supply and is coupled with and supplies electrical power to the other components of circuitry 120. Controller 60 is in communication with the other components of circuitry 120 and is operable to send and receive information and control signals therewith. Though not depicted in the embodiment shown in FIG. 7, the sensor 55 can also be incorporated and that also communicates with the controller 60.

Transceiver 124 is operable to send and receive radio frequency signals on a specified channel in accordance with specified communication protocol. In one exemplary form, transceiver 124 is configured according to the Z-Wave wireless communication standard which operates at about 136 MHz and is operable to send and receive Z-Wave compatible transmissions. It shall be appreciated, however, that additional and alternate communication channels and protocols may also be utilized.

Transceiver 124 is in operative communication with controller 60 and is controllable thereby. Controller 60 is operable to receive information demodulated by transceiver 124 and to provide information to transceiver 124 for modulation and transmission. Decoding of received, demodulated information and encoding of information to be modulated and transmitted may be performed by any of transceiver 124, controller 60, additional or alternate circuitry, or combinations thereof. Controller 60 is further operable to command transceiver 124 to enter sleep and wake modes. In wake mode, transceiver 124 is turned on and is operable to send and receive radio signals in accordance with a specified protocol. In sleep mode, transceiver 124 is substantially turned off, and draws reduced current and consumes less power from power supply 122 relative to wake mode. Preferably transceiver 124 draws substantially no current in sleep mode, for example, only current needed to facilitate and allow signal detection and transition to a wake mode, though in some embodiments some additional current draw associated with other functionalities may occur in sleep mode.

Receiver 26 is operable to receive the same radio frequency signals on the same specified channel utilized by transceiver 124. In some forms receiver 126 is operable to receive and demodulate signals in accordance with the same specified communication protocol utilized by transceiver 124. Receiver 126 is in operative communication with controller 60 and is controllable thereby. Receiver 126 is controlled by controller 60 to poll the specified channel for radio transmissions including one or more specified characteristics. Upon detection of a signal including the one or more specified characteristics, receiver 126 is operable to send a wake up request to controller 60. In some exemplary embodiments, specified characteristic is a received signal strength indication (RSSI) that is provided to the controller 60 or other processing circuitry for comparison with a threshold. In some embodiments the RSSI is compared to a threshold by receiver 126 or by receiver 126 in combination with other circuitry. Controller 60 is operable to receive and process the wake up request and send a wake command to transceiver 124. Upon receipt of a wake up request, transceiver 124 wakes and is operable to send and receive radio signals in accordance with a specified protocol.

Receiver 126 is configured to draw lower current and consume less power during polling operation than would be drawn or consumed if transceiver 124 were utilized to perform a polling operation. Controller 60 may also control receiver 126 to suspend its polling or enter a standby mode when transceiver 124 is awake in order to further mitigate current drain and power consumption. Additionally, controller 60 may itself enter a reduced power mode or sleep mode which provides reduced current drain and power consumption relative to full operation while maintaining the ability to control receiver 126 to periodically poll for a signal, and receive a wake up request from receiver 126 or other system components.

Receiver 126 may be provided with a number of signal identification functionalities. In some forms receiver 126 is operable to evaluate RSSI information and to send a wake request to controller 60 based upon an evaluation of the RSSI relative to one or more specified criteria, for example, evaluating signal strength on a specified channel to determine when a remote device or system is attempting to communicate with controller 60. In additional forms, receiver 126 is operable to evaluate information encoded by a received signal. The encoded information may include, for example, a transmission type identifier, a device ID, a key or credential, other types of identifying information, or combinations thereof. In certain forms the receiver is operable to detect a Z-Wave preamble and has the capacity to distinguish between a true Z-Wave signal and other signals that may be present in the Z-Wave communication band based upon detection of a Z-Wave preamble. This functionality may reduce the number of false wake up requests generated by the receiver 126.

In some forms receiver 126 is operable to detect a Z-Wave device ID and evaluate whether the Z-Wave communication is meant for controller 60 or another Z-Wave device. This may also mitigate the false wake up requests by receiver 126 due to other Z-Wave devices communicating on the same channel or network. In some forms receiver 126 is operable to receive a beam from one or more nodes of a dynamically configurable wireless network. Z-Wave networks are one example of a dynamically configurable wireless network. Z-Wave networks are mesh networks wherein each node or device on the network is operable to send and receive signals including control commands. When one device in a Z-Wave network wants to communicate with another, it transmits a signal through a network pathway that may include a plurality of nodes through which the signal is relayed to its intended recipient node. Utilization of intermediate nodes facilitates transmission of signals around transmission obstacles such as interfering structures or devices and radio dead spots. A master controller node may be used to dynamically control or optimize the transmission pathway to be utilized by other nodes to communicate with one another. The master controller may send a beam and receive a response and use this information to evaluate or optimize various network transmission pathways. A Z-Wave beam is a periodically transmitted sequence of bits that repeat for a predetermined duration. Certain bits in the repeating sequence includes a preamble to identify the transmission type as a Z-Wave transmission. Additional bits and an additional component that identifies node ID of the intended recipient may also be present in some forms. It shall be appreciated that additional information may, but need not be, included in a beam-type transmission.

In some exemplary embodiments transceiver 134 may be configured as a master controller node and receiver 126 may be configured as a transceiver. In such embodiments, communication to circuitry 120 may be initiated by transceiver 134 sending a beam that includes a device ID associated with circuitry 120 through a pathway of the dynamic network. Receiver 126 may then receive this transmission, identify it as a Z-Wave transmission, and identify that it is the intended recipient, initiate a wake up of transceiver 124 to receive a subsequent transmission, and transmit a response to transceiver 134 through a predetermined pathway indicating that the beam was received. The response may be provided to the master controller associated with transceiver 134 and used in connection with control, organization and optimization of the dynamic network.

In certain other embodiments, such as those where receiver 126 does not include transmission capability, the node ID associated with circuitry 120 may be utilized to further identify transceiver 134 as a potential sleeper, such as a FLiRS (frequently listening routing servant) node. Alternatively a separate potential sleeper identifier may be used. The potential sleeper identifier may be utilized by the master controller in controlling beam transmission and network configuration, operation and optimization. For example, the master controller may increase the duration of the beam or a subsequent transmission to account for the delay between the receipt of a beam by receiver 126 and the waking and transmission of a confirmation signal by transceiver 124. Additionally or alternatively the master controller or another node attempting to send a post-beam transmission may delay or otherwise change the timings of the transmission or may repeat or resend the transmission to account for wakeup delay. Additionally or alternatively, the master controller may account for potential delay by adjusting the time period or deadline within which it expects to receive the confirmation signal for transmissions of a beam or post-beam transmission to a potential sleeper node, and/or adjusting its control, configuration operation and optimization routines to account for the fact that it may not receive a response signal when expected. The master controller may also account for potential delay by sending duplicate transmission to account for the possibility that a sleeper node may be sleeping.

It shall be appreciated that decoding, processing and other functionalities disclosed herein may be performed by receiver 126, controller 60, additional or alternate circuitry, or combinations thereof. Additionally, it shall be appreciated that in some forms receiver 126 may be a transceiver also having the capability to transmit radio frequency signals on the specified channel and in accordance with the specified communication protocol utilized by transceiver 124. In some embodiments this transceiver may be operable to transmit a signal in response to a specified transmission in order to avoid the sending device from mistakenly concluding that its intended recipient is not operational. In some forms the response may include a request for retransmission of the same information so that it can be received by transceiver 124. Such functionalities may be used in connection with dynamic networks such as dynamically configurable networks whose operation and optimization depends upon receipt of responses and may be time sensitive.

Motor control circuitry 128 is operable to control a motor to actuate a locking mechanism, such as via the electronic actuator 33 discussed above. Circuitry 128 is in operative communication with controller 60 and is operable to send information thereto and receive information therefrom. The motor control circuitry 128, furthermore, can be configured to sense a position of a locking mechanism.

User input circuitry 130 is operable to receive credentials input by a user, for example, from a keypad, touchpad, swipe card, proximity card, key FOB, RFID device, biometric sensor or other devices configured to provide an access credential that can be evaluated to determine whether or not to actuate a locking mechanism to provide or deny access to a user. Circuitry 130 is in operative communication with controller 60 and is operable to send information thereto and receive control signals and other information therefrom.

FIG. 7 further illustrates a remote transceiver 134 which is operable to transmit and receive information on the same specified channel and using the same specified communications protocol as transceiver 124 and receiver 126. Remote transceiver 134 is in operative communication with server 140 which is operable to send control signals and other information thereto and receive information therefrom. Server 140 is connected to and provides communication with network 136 which may include a local area network, wide area network, the internet, other communication networks, or combinations thereof. Remote transceiver 134 is operable to communicate with at least transceiver 124 and receiver 126, and may also communicate with one or more additional networked devices 138 which may themselves communicate with transceiver 124 or receiver 126.

In some exemplary embodiments communication between transceiver 124, transceiver 126, transceiver 134, and/or networked devices 138 may occur over a dynamically configurable wireless network. Certain exemplary embodiments enhance performance and compatibility of sleep/wake transceiver systems and dynamically configurable wireless networks by providing configuring transceiver 124 to receive a first signal transmitted by a control node of a dynamic wireless network, such as transceiver 134. The first signal may include an intended recipient ID. Transceiver 124 may be operable to demodulate the first signal and provide the intended recipient ID to controller 60. Controller 60 may be operable to evaluate the intended recipient ID and selectably control transceiver 124 to transmit an acknowledgment signal based upon this evaluation. This acknowledgement signal can be received by transceiver 134 and provided to server 140 for use in controlling, maintaining or optimizing a dynamic wireless network such as a dynamically configurable wireless network. The acknowledgment signal sent by transceiver 124 upon receipt of a signal from a control node may include an information retransmission request. The retransmission request may be received by transceiver 134 and provided to server 140 for use in providing information to transceiver 126. In some forms the retransmission request may be a request to transmit substantially the same information to transceiver 126 as was transmitted to transceiver 124. In some forms the retransmission request may be a request to transmit additional or different information to transceiver 126 than was transmitted to transceiver 124.

Transceiver 126 may be configured to wake up in response to a wake up command from the controller which may be triggered by a wake up request sent to controller 60 from transceiver 124. In some forms the transmission of the intended recipient ID may serve as a wake up request. In other forms other signals may be used. Once awake, transceiver 126 may receive a second radio signal from the control node of the dynamic wireless network. The second signal may include door lock access information. Transceiver 126 may be operable to demodulate the second signal and provide the door lock access information to controller 60 which can evaluate the door lock access information and command actuation of a locking mechanism such as those described herein based upon the evaluation.

Alternatively or additionally, the second signal may include door lock query information that may be demodulated by transceiver 126, provided to controller 60 and used to sense information of a locking mechanism position. Controller 60 may be further operable to control transceiver 126 to transmit this locking mechanism position information which can be received by other nodes of the network, such as transceiver 134, and provided to server 140 or other designated destinations. A number of types of information of a locking mechanism position may be sensed including the position of the locking mechanism such as a deadbolt in accordance with the position sensing devices and techniques disclosed herein. Additionally, some embodiments may determine whether locking mechanism was last actuated manually or automatically.

Some exemplary dynamic network embodiments include further features which will now be described. The signal received by transceiver 124 and the signal received by transceiver 126 may be transmitted on the same channel such as on the same frequency or band, may conform to the same transmission protocol, may include substantially the same information, may differ in their informational content only with respect to information pertaining to transmission time or transmission ID, and/or the two signals may be substantially identical. Either or both signals may include door lock access information, intended recipient information and/or other information. Either or both signals may be encrypted and encoded in various manners.

Some exemplary dynamic network embodiments may include additional features. Transceiver 124 and 126 may share a common antenna or may utilize separate antennas. Transceiver 124 and controller 60 may be operable to first evaluate the strength of a radio signal relative to a first criterion, such as a received signal strength indication, and second evaluate the intended recipient ID based upon said the first evaluation. Controller 60 may control transceiver 124 to periodically poll for a first signal while transceiver 126 is asleep, and control transceiver 126 to periodically poll for a signal when awake. Transceiver 124 may draws less current when periodically polling than transceiver 126 when periodically polling. Controller 60 may be operable to sense locking mechanism position information and control a locking mechanism in accordance with one or more of the techniques disclosed herein or alternate or additional techniques.

As will be appreciated given the discussion above, when the sensor 55 detects that the lock mechanism 25 has been tampered with or defeated such as through a kick-in, an alarm can be triggered to alert responsible individuals and/or the authorities of such an event. The alarm can be a local alarm sounder either at the door or at a remote panel on the premises, or an alarm can be set at a remote location. When the alarm indication is local, in some embodiments the alarm indication can be incorporated with the controller 60 in the circuitry 120. In addition, whether the alarm is indicated locally at the door or remotely from the door, the alarm can take the form of a piezo alarm sounder. The alarm can additionally and/or alternatively take the form of a visual signal, message, etc.

In some embodiments the lock mechanism 25 can be configured to communicate to a user through a portal, for example a web-based portal, in which the user can interrogate the lock mechanism 25 or carry out any number of useful actions. The portal can be provided to communicate over the network 136 with the locking mechanism 25 such as to determine alarm status, set one or more thresholds as discussed above, along with any number of other features described further below. FIGS. 8 and 9 described further below set forth additional details of the lock mechanism 25, alarm settings, and communication with a remote user over a network. Both FIGS. 8 and 9 are disclosed in table format and include various capabilities as will be evident from the table itself.

The columns of FIG. 8 are set up to describe capabilities of the lock mechanism 25 as provided to a user through a portal, such as a web based portal, as well as capabilities provided at the local lock location. A column is also provided to describe what type of information is shown at the portal. The last two columns describe whether a z-wave message is provided either outbound or inbound to the lock mechanism 25.

The rows of FIG. 8 are set up to describe whether the alarm can be turned on or off, what mode the alarm is configured in, the sensitivity of the alarm mode (in one embodiment, the sensitivity is directly related to the threshold(s) described above), whether an alarm is in process, and whether the alarm can be cancelled. Other rows of FIG. 8 also show additional features of the local Schlage button (a button that can be separate and apart from an alphanumeric key) available to a portal user/customer, as well as the type of notification available to a portal user/customer.

The columns of FIG. 9 depict the type of reaction, either locally at the lock mechanism 25 or whether a message is sent remotely to a portal, when consecutive invalid personal identification numbers (PINS), or other types of authentication attempts, are provided. The rows of FIG. 9 set forth the type of mode and the response to a local alarm, such as a local alarm sounder.

In some embodiments that follow the descriptions provided in FIGS. 8 and 9, the type of mode that the alarm has been configured in is limited to one type of mode at a time. For example, the lock mechanism 25 can be configured to be placed in tamper mode which can be capable of detecting and sending message(s) related to a tamper event. Such a tamper event can include a threshold(s) set at the milli-g level of acceleration. The kick-in mode can include a higher threshold(s) such that if the lock mechanism 25 is placed in kick-in mode it will not send message(s) related to a relatively small amount of acceleration, even if that acceleration is indicative of a tamper event.

The threshold(s) related to each of the modes can be adjusted according to the sensitivity setting. For example, the sensitivity of the tamper mode can be set at a relatively low level of 1 which will only provide an alarm indication when accelerations are relatively large. The sensitivity of the kick-in mode can be set to a relatively high level of 5 which will only provide an alarm indication when accelerations are relatively low. Thus, low sensitivity in the tamper mode approaches the acceleration levels of a high sensitivity setting in the kick-in mode. It is contemplated that the ranges of sensor sensitivity available in the tamper mode are separate from the ranges of sensor sensitivity available in the kick-in mode, but other variations are certainly possible.

In some embodiments local alarms are not generated and Z-Wave messages are not sent if the alarms are in Alert mode.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system for generating an alarm associated with acceleration of a door, comprising:

a door lock mechanism installed with a door panel that includes a lock and permits entry through the door based on a status of the lock;

an accelerometer coupled to the door lock mechanism and configured to detect motion of the door; and a controller configured to:

determine whether an acceleration detected by the accelerometer is less than an acceleration threshold of the door, wherein the acceleration threshold is an acceleration that, when exceeded by the door, is indicative of a forced entry; and maintain the alarm associated with the acceleration of the door and the door lock mechanism in a deactivated state when the acceleration of the door detected by the accelerometer is less than the acceleration threshold.

2. The system of claim 1, wherein the controller is further configured to determine the acceleration of the door based on the motion of the door detected by the accelerometer in a Z-axis direction as the door approaches a door frame, and wherein the acceleration of the door as detected by the accelerometer in the Z-axis direction is initiated when the door contacts the door frame.

3. The system of claim 2, wherein the controller is further configured to fail to determine the acceleration of the door based on the motion of the door detected by the accelerometer in the Z-axis direction before the door approaches the door frame, and wherein the acceleration of the door as detected by the accelerometer in the Z-axis direction is substantially zero before the door contacts the door frame.

4. The system of claim 3, wherein the controller is further configured to:

determine whether an initial acceleration detected by the accelerometer when the acceleration of the door is initially detected by the accelerometer is less than an initial acceleration threshold of the door, and wherein the initial acceleration of the door when less than the initial acceleration threshold of the door is indicative that the door is initially in a closed state and is in contact with the door frame; and maintain the alarm associated with the door lock mechanism in the deactivated state when the initial acceleration of the door detected by the accelerometer is greater than the initial acceleration threshold of the door, and wherein the initial acceleration of the door being greater than the initial acceleration threshold of the door is indicative that that door is initially in an open state and is moving before contacting the door frame.

5. The system of claim 4, wherein the controller is further configured to:

determine whether a subsequent acceleration of the door detected by the accelerometer following the initial acceleration of the door detected by the accelerometer is less than the acceleration threshold of the door; and maintain the alarm associated with the acceleration of the door and the door lock mechanism in the deactivated state when the subsequent acceleration of the door detected by the accelerometer is less than the acceleration threshold.

6. The system of claim 5, wherein the controller is further configured to:

determine whether the initial acceleration of the door is detected as being less than the initial acceleration threshold by the accelerometer when the subsequent acceleration of the door is detected by the accelerometer as exceeding the acceleration threshold of the door; and maintain the alarm associated with the door lock mechanism in the deactivated state when the initial acceleration of the door is detected as being greater than the initial acceleration threshold and when the subsequent acceleration of the door is detected by the accelerometer as exceeding the acceleration threshold, and wherein the initial acceleration of the door when greater than the acceleration threshold of the door is indicative that the door is initially in the open state and moving before contacting the door frame and is not indicative of a forced entry when the subsequent acceleration of the door is detected by the accelerometer as exceeding the acceleration threshold of the door.

7. The system of claim 6, wherein the controller is further configured to:

activate the alarm associated with the acceleration of the door and the door lock mechanism when the initial acceleration of the door detected by the accelerometer is below the initial acceleration threshold of the door and the subsequent acceleration of the door detected by the accelerometer exceeds the acceleration threshold of the door, and wherein the initial acceleration of the door when less than the acceleration threshold of the door is indicative that the door is initially in the closed state and is in contact with the door frame and the subsequent acceleration of the door when exceeding the acceleration threshold of the door is indicative of a forced entry due to the door initially being in the closed state and then accelerating above the acceleration threshold.

8. The system of claim 6, wherein the controller is further configured to:

determine whether the detected motion of the door is authorized to be in an open position, and wherein the detected motion of the door is indicative that the door is transitioned between the open position and a closed position; and trigger the alarm associated with the acceleration of the door and the door lock mechanism when the acceleration of the door fails to satisfy the acceleration threshold and the detected motion of the door is not authorized to be in the open position.

9. The system of claim 8, wherein the controller is further configured to maintain the alarm associated with the acceleration of the door and the door lock mechanism in the deactivated state when the acceleration of the door satisfies the acceleration threshold and the detected motion of the door is authorized to be in the open position.

10. The system of claim 9, wherein the controller is further configured to activate the alarm associated with the acceleration of the door and the door lock mechanism when the acceleration of the door satisfies the acceleration threshold and the detected motion of the door is not authorized to be in the open position.

11. The system of claim 10, wherein the controller is further configured to activate the alarm associated with the acceleration of the door and the door lock mechanism when the acceleration of the door fails to satisfy the acceleration threshold and the detected motion of the door is authorized to be in the open position.

12. The system of claim 11, wherein the controller is further configured to:

determine whether the door is in the closed position within a time threshold after the detected motion of the door is indicative that the door is in the open position; and activate the alarm associated with the acceleration of the door and the door lock mechanism when the door fails to be in the closed position within the time threshold after the detected motion of the door is indicative that the door is in the open position, and wherein the door failing to be in the closed position within the time threshold after the detected motion of the door is indicative that the door is in the open position and indicative of the forced entry.

13. The system of claim 11, wherein the controller is further configured to maintain the alarm associated with the acceleration of the door and the door lock mechanism in the deactivated state when the door satisfies the acceleration threshold, and wherein the detected motion of the door is authorized to be in the open position and the door is in the closed position within the time threshold after the detected motion of the door is indicative that the door is in the open position.

14. A method for generating an alarm associated with acceleration of a door, comprising:

determining whether an acceleration of the door detected by an accelerometer is less than an acceleration threshold of the door, wherein the acceleration threshold is an acceleration that when exceeded by the door is indicative of a forced entry; and maintaining the alarm associated with the acceleration of the door and a door lock mechanism in a deactivated state when the acceleration of the door detected by the accelerometer is less than the acceleration threshold of the door.

15. The method of claim 14, wherein the determining comprises:

determining the acceleration of the door based on motion of the door detected by the accelerometer in a Z-axis direction as the door approaches a door frame, and wherein the acceleration of the door is detected by the accelerometer in the Z-axis direction and is initiated when the door contacts the door frame.

16. The method of claim 15, wherein the determining the acceleration of the door further comprises:

failing to determine the acceleration of the door based on the motion of the door detected by the accelerometer in the Z-axis direction before the door approaches the door frame, and wherein the acceleration of the door as detected by the accelerometer in the Z-axis direction is substantially zero before the door contacts the door frame.

17. The method of claim 16, further comprising:

determining whether an initial acceleration detected by the accelerometer when the acceleration of the door is initially detected by the accelerometer is less than an initial acceleration threshold of the door, wherein the initial acceleration of the door when less than the initial acceleration threshold of the door is indicative that the door is initially in a closed state and is in contact with the door frame; and maintaining the alarm associated with the door lock mechanism in the deactivated state when the initial acceleration of the door detected by the accelerometer is greater than the initial acceleration threshold of the door, wherein the initial acceleration of the door being greater than the initial acceleration threshold of the door is indicative that the door is initially in an open state and is moving before initiating contact with the door frame.

18. The method of claim 17, further comprising:

determining whether a subsequent acceleration of the door detected by the accelerometer following the initial acceleration of the door detected by the accelerometer is less than the acceleration threshold of the door; and maintaining the alarm associated with the acceleration of the door and the door lock mechanism in the deactivated state when the subsequent acceleration of the door detected by the accelerometer is less than the acceleration threshold.

19. The method of claim 18, further comprising:

determining whether the initial acceleration of the door is detected as being less than the initial acceleration threshold by the accelerometer when the subsequent acceleration of the door is detected by the accelerometer as exceeding the acceleration threshold of the door; and maintaining the alarm associated with the acceleration of the door and the door lock mechanism in the deactivated state when the initial acceleration of the door is detected as being greater than the initial acceleration threshold and when the subsequent acceleration of the door is detected by the accelerometer as exceeding the acceleration threshold, and wherein the initial acceleration of the door when greater than the acceleration threshold of the door is indicative that the door is initially in the open state and moving before contacting the door frame and is not indicative of a forced entry when the subsequent acceleration of the door is detected by the accelerometer as exceeding the acceleration threshold of the door.

20. The method of claim 19, further comprising:

activating the alarm associated with the acceleration of the door and the door lock mechanism when the initial acceleration of the door detected by the accelerometer is below the initial acceleration threshold of the door and the subsequent acceleration of the door detected by the accelerometer exceeds the acceleration threshold of the door, and wherein the initial acceleration of the door when less than the acceleration threshold of the door is indicative that the door is initially in the closed state and is in contact with the door frame and the subsequent acceleration of the door when exceeding the acceleration threshold of the door is indicative of a forced entry due to the door initially being in the closed state and then accelerating above the acceleration threshold.

* * * * *